US007441580B2

(12) United States Patent
Lee

(10) Patent No.: US 7,441,580 B2
(45) Date of Patent: Oct. 28, 2008

(54) MAGNETIC ADHESIVE TAPE HOLDER

(75) Inventor: Yi-Ju Lee, Dou-Lio (TW)

(73) Assignee: Jasdi Magnet Co., Ltd (TW)

( * ) Notice: Subject to any disclaimer, the term of this patent is extended or adjusted under 35 U.S.C. 154(b) by 633 days.

(21) Appl. No.: 11/195,729

(22) Filed: Aug. 3, 2005

(65) Prior Publication Data

US 2007/0029048 A1 Feb. 8, 2007

(51) Int. Cl.
*B32B 38/04* (2006.01)
*B32B 37/14* (2006.01)

(52) U.S. Cl. ..... 156/527; 156/574; 156/577; 225/76; 225/77; 225/84

(58) Field of Classification Search ..... 156/523, 156/527, 574, 577, 579; 225/56, 76, 77, 225/79, 84

See application file for complete search history.

(56) References Cited

U.S. PATENT DOCUMENTS 5,316,613 A * 5/1994 Samuelson et al. ..... 156/540
5,326,421 A * 7/1994 Taylor ..... 156/526
5,507,908 A * 4/1996 Fukushima et al. ..... 156/363
7,204,287 B2 * 4/2007 Casaldi et al. ..... 156/523
2003/0024651 A1 * 2/2003 Urushizaki ..... 156/577

* cited by examiner

*Primary Examiner*—Mark A Osele
(74) *Attorney, Agent, or Firm*—Lowe Hauptman Ham & Berner, LLP

(57) ABSTRACT

A magnetic adhesive tape holder includes an upper housing and a lower housing movably received in the upper housing. Two first resilient members are provided between the upper and lower housings to give the lower housing a tendency to move away from the upper housing. A clamping member is formed on the upper housing and extends into the second housing. The clamping member is in an open status when the upper housing is not pressed towards the lower housing, and in a closed status when the upper housing is pressed towards the lower housing. A first gear and a second gear are rotatably mounted on the second rear wall and engaged with each other. A cutting member is mounted on the second rear wall and beneath the first gear. A roll of magnetic adhesive tape provided in the holder can be automatically and easily cut off with a determined length.

18 Claims, 8 Drawing Sheets

MAGNETIC ADHESIVE TAPE HOLDER

BACKGROUND OF THE INVENTION

1. Field of the Invention

The present invention relates to a magnetic adhesive tape holder, and more particularly to a holder which can automatically cut a roll of magnetic adhesive tape with a predetermined length and stick the cut segment of the magnetic adhesive tape.

2. Description of Related Art

A magnetic adhesive tape includes an adhesive side which is generally combined with a substrate tape. The magnetic adhesive tape and the substrate tape are reeled as a single roll. In use, the roll of magnetic adhesive tape is unreeled and cut off with a desired length. Thereafter, the cut segment of magnetic adhesive tape can be stuck on an article, and the article with the magnetic adhesive tape can be attracted on an iron product such as a refrigerator.

However, it is very inconvenient to manually cut off the magnetic adhesive tape and to control the length of the cut segment.

Therefore, the invention provides a magnetic adhesive tape holder to mitigate or obviate the aforementioned problems.

SUMMARY OF THE INVENTION

The main objective of the present invention is to provide a magnetic adhesive tape holder which can automatically cut off a segment of the magnetic adhesive tape with a predetermined length.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
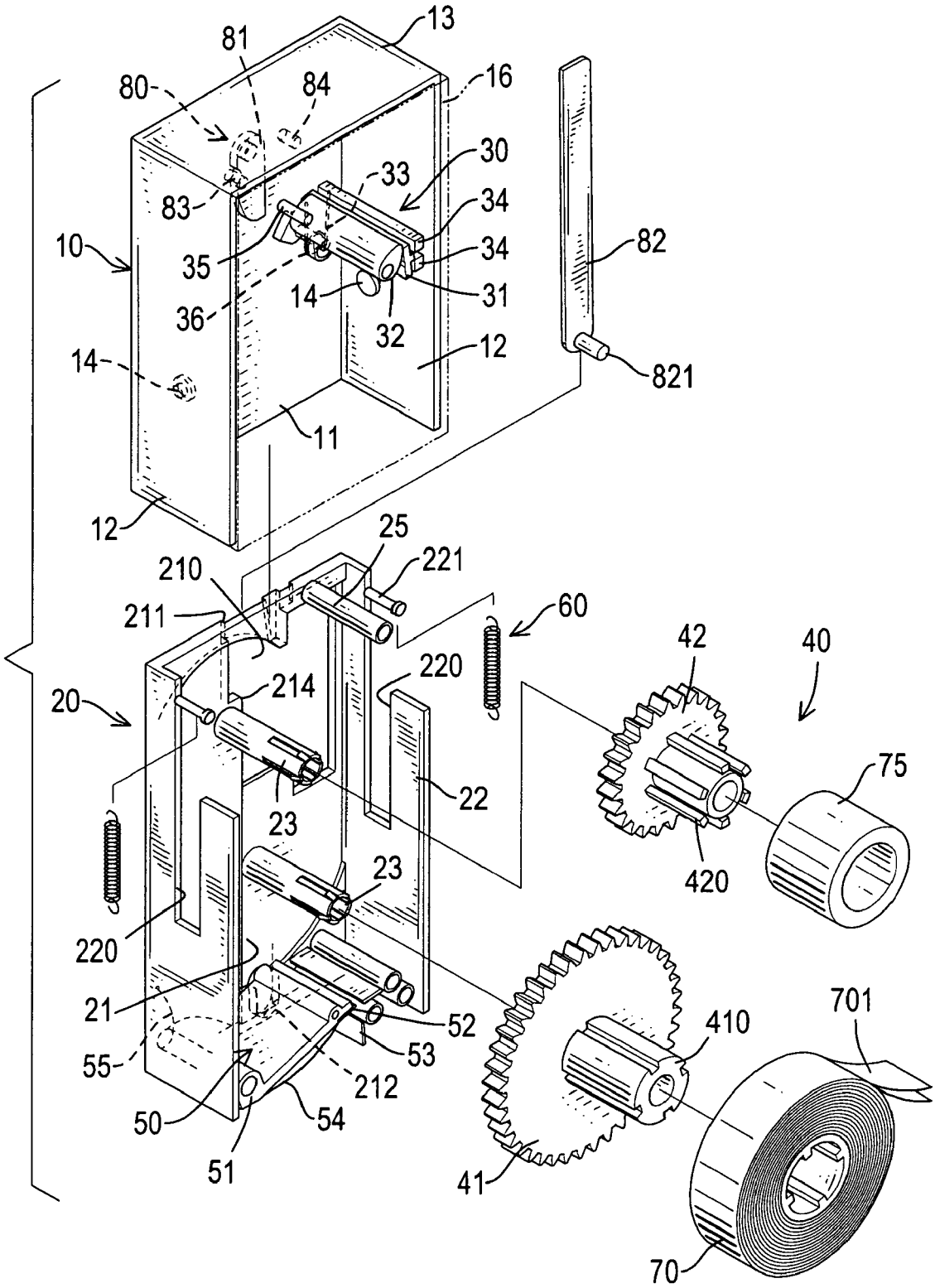
FIG. 1 is an exploded perspective view of a magnetic adhesive tape holder in accordance with the present invention.
Figure 2:
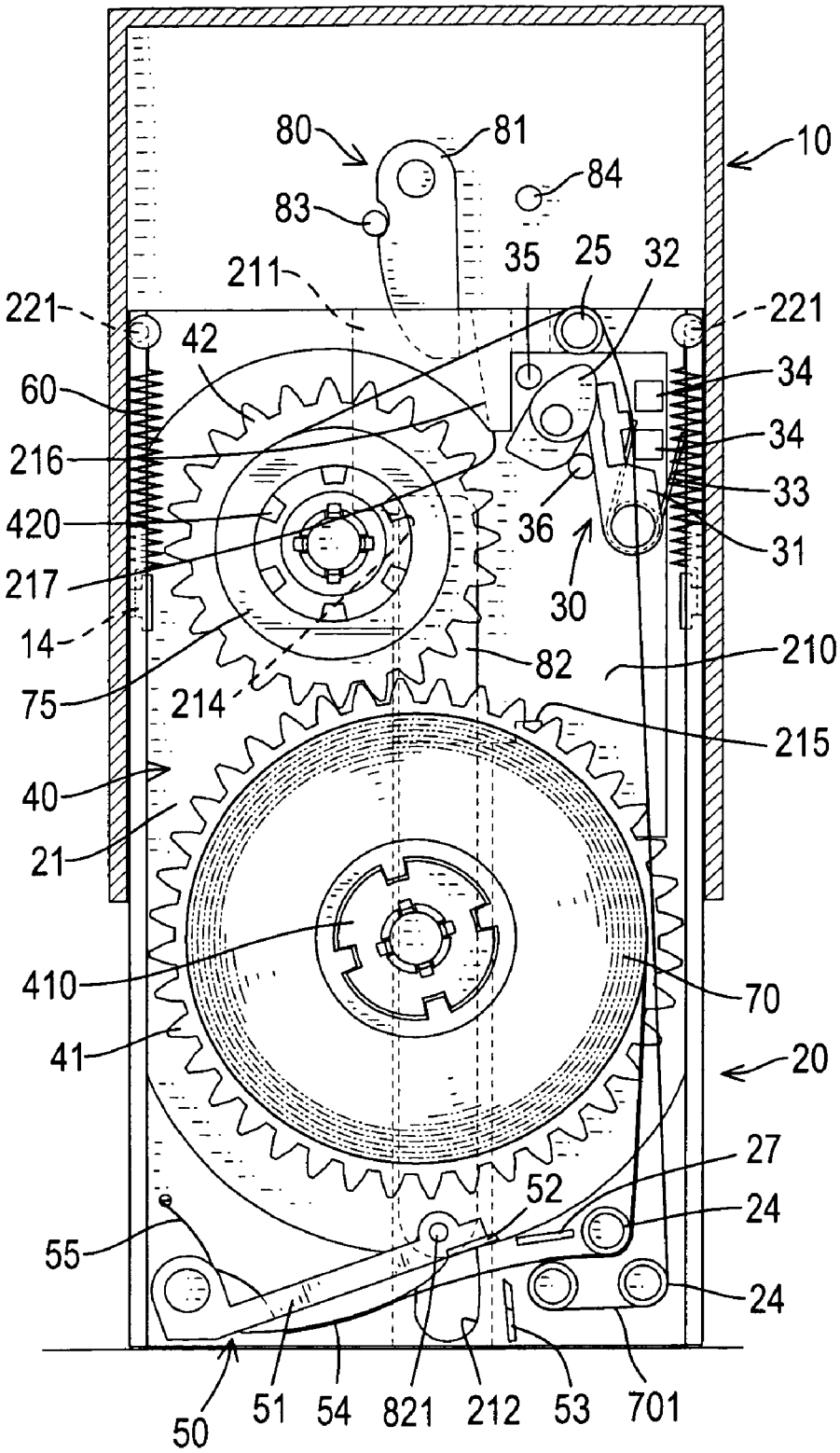
FIG. 2 is a cross sectional view of the magnetic adhesive tape holder of FIG. 1.

With reference to FIGS. 1-2, a magnetic adhesive tape holder in accordance with the present invention has an upper housing (10) with a first rear wall (11), two opposed first sidewalls (12) perpendicular to the first rear wall (11), and a top wall (13) between the sidewalls (12). Two first pins (14) are respectively formed at the first sidewalls (12). A cover (16) is provided at a front side of the upper housing (10).

A lower housing (20) is movably received in the upper housing (10) and has a second rear wall (21), and two opposed second sidewalls (22) perpendicular to the second wall (21). Two slots (220) are respectively defined through the opposed second sidewalls (22), and two second pins (221) are respectively formed above the slots (220). The first pins (14) are respectively inserted in the slots (220) and located beneath the second pins (221). Two first resilient members (60) are respectively connected between the first pins (14) and second pins (221) to elastically position the lower housing (20) in the upper housing (10).

A clamping member (30) is formed on the first rear wall (11) of the upper housing (10). An opening (210) is defined through the second rear wall (21) and the clamping member (30) extends in the lower housing (20) through the opening (210). The clamping member (30) includes a movable clamper (31) pivotally mounted on the first rear wall (11). An eccentric cam (32) is rotatably mounted beside the movable clamper (31). The movable clamper (31) is pushed by a torsion spring (33) to abut the eccentric cam (32). Two stationary clampers (34) are provided beside the movable clamper (31) and opposite to the eccentric cam (32). Thus, a space is defined between the movable clamper (31) and the stationary clampers (34). A first stop pin (35) and a second stop pin (36) are respectively formed above and beneath the eccentric cam (32).

A pushing member (80) includes a rotating cam (81) pivotally mounted on the first rear wall (11). A first stop lug (83) and a second stop lug (84) are respectively provided at two opposed sides of the rotating cam (81). The rotating cam (81) has an arcuate edge facing the first stop lug (83) and a substantially straight edge facing the second stop lug (84). A guide slot (211) is defined at a back surface of the second rear wall (21) and in communication with the opening (210). A push bar (82) is movably received in the guide slot (211), i.e., provided between the first rear wall (11) and the second rear wall (21). A bolt (821) is formed at a bottom end of the push bar (82) and extends through a hole (212) defined at a bottom end of the second rear wall (21). The rotating cam (81) is able to be inserted into the opening (210) along the guide slot (211).

The second rear wall (21) has a first step (214) formed in the opening (210). The first step (214) is located in the guide slot (211) and aligned with the rotating cam (81). A second step (215) is also formed in the opening (210) and beneath the first step (214) and aligned with the eccentric cam (32). A first stopping portion (216) and a second stopping portion (217) are formed at a top of the opening (210), wherein the first stopping portion (216) faces the rotating cam (81) and the second stopping portion (217) faces the eccentric cam (32). The rotating cam (81) will be pivoted upwards when it is pushed by the first step (214), and will be pivoted downwards when it is pushed by the first stopping portion (216). The eccentric cam (32) will be rotated clockwise when it is pushed by the second step (215), and will be rotated counterclockwise when it is pushed by the second stopping portion (217). The rotations of the rotating cam (81) and the eccentric cam (32) will be further described hereinafter.

A cutting member (50) is provided at the bottom of the second rear wall (21). The cutting member (50) has an arm (51) with a pivot end and a free end. The bolt (821) extending through the hole (212) is inserted in the arm (51), so the arm (51) will be pivoted about the pivot end when the push bar (82) is moved. A first blade (movable blade) (52) is provided at the free end of the arm (51). A second blade (immovable blade) (53) is secured on the second rear wall (21) and located beneath the first blade (52) and beside the hole (212). A gap is defined between the first blade (52) and second blade (53). An arcuate elastic iron strip (54) is provided on a bottom surface of the arm (51), and a second resilient member (55) is provided at the pivot end of the arm (51) to make the free end of the arm (51) ascend.

Two parallel axles (23) are rotatably mounted on the second rear wall (21) and above the cutting member (50). A gear assembly (40) includes a first gear (41) and a second gear (42) respectively mounted on the axles (23) and engaged with each other. A first pole (410) is formed on the center of the first gear (41), and a second pole (420) is formed on the center of the second gear (42). A roll of magnetic adhesive tape (70) with a substrate tape (701) is provided on the first pole (410), and a sleeve (75) is provided on the second pole (420). The magnetic adhesive tape (70) is formed with a magnetic side and an adhesive side stuck on the substrate tape (701).

Three lower rollers (24), including a top one and two bottom ones arranged as a triangle, are provided under the axles (23) and beside the free end of the arm (51). A shield (27) is formed above the bottom one of the lower rollers (24) that is adjacent the second blade (53). An upper roller (25) is provided above the eccentric cam (32).

The magnetic adhesive tape (70) extends over the top lower roller (24) and the magnetic side of the magnetic adhesive tape (70) is attracted on the arcuate elastic iron strip (54). The substrate tape (701) is separated from the magnetic adhesive tape (70) and extends over the two bottom lower rollers (24). Then, the substrate tape (701) extends upwards between the movable clamper (31) and the stationary clampers (34) and over the upper roller (25) to be reeled on the sleeve (75).

In a non-use status, the magnetic side of the free end of the magnetic adhesive tape (70) is attracted on the arcuate elastic iron strip (54). The substrate tape (701) extends through the spacing between the movable clamper (31) and stationary clampers, i.e., the substrate tape (701) is not clamped by the clamping member (30). Under the force of the resilient members (60), the upper housing (10) is pushed away from the lower housing (20). The rotating cam (81) is partly received in the guide slot (211) and is disengaged from the push bar (82).

Figure 3:
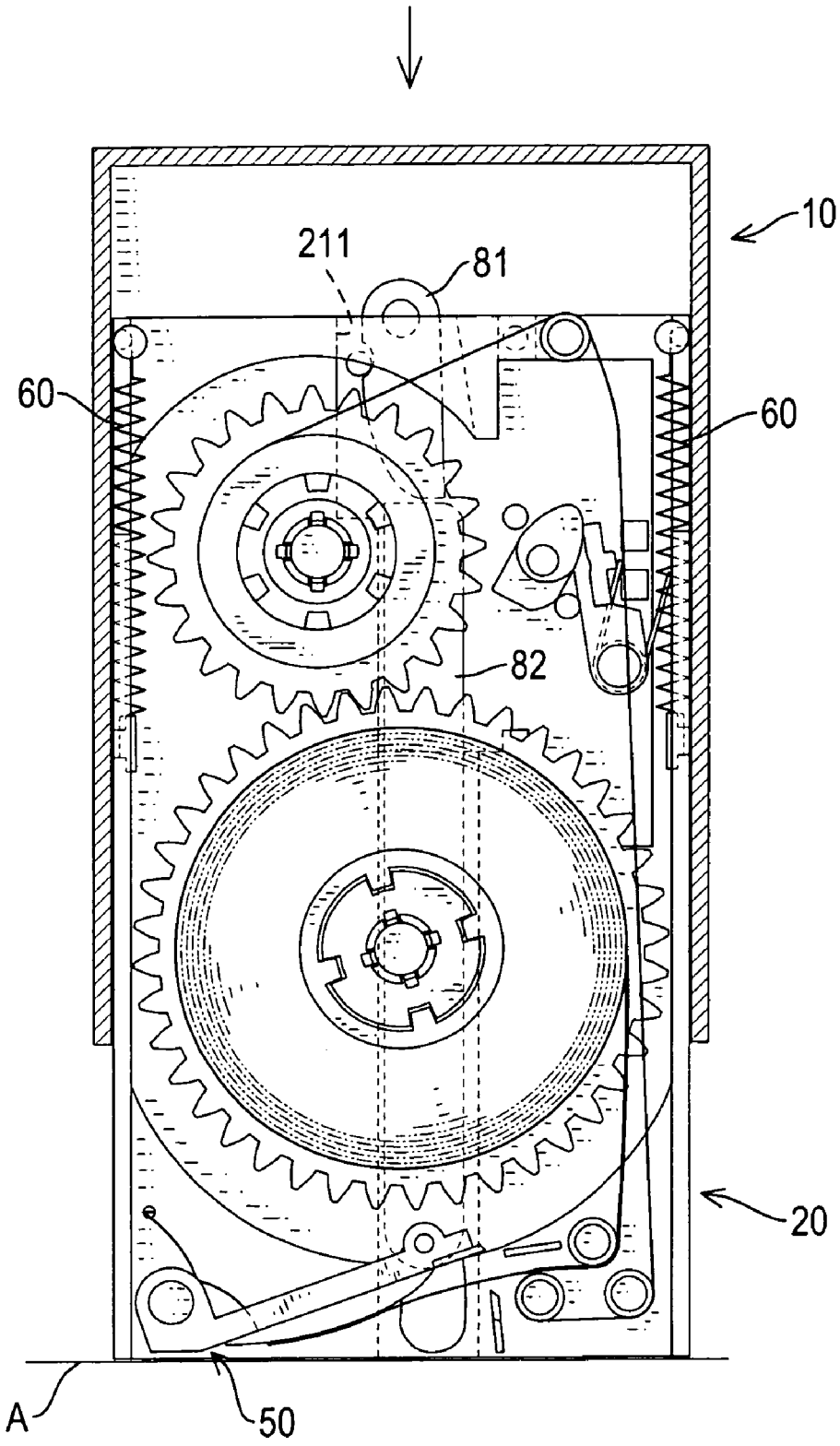
FIG. 3 is a cross sectional view of the magnetic adhesive tape holder when an upper housing is pressed towards a lower housing.

In use, with reference to FIG. 3, the bottom end of the lower housing (20) abuts a surface of an article (A) that is required to be stuck. The upper housing (10) is pressed towards the lower housing (20), and the rotating cam (81) is moved along with the upper housing (10) to close to the push bar (82) while the first resilient members (60) are tightened.

Figure 4:
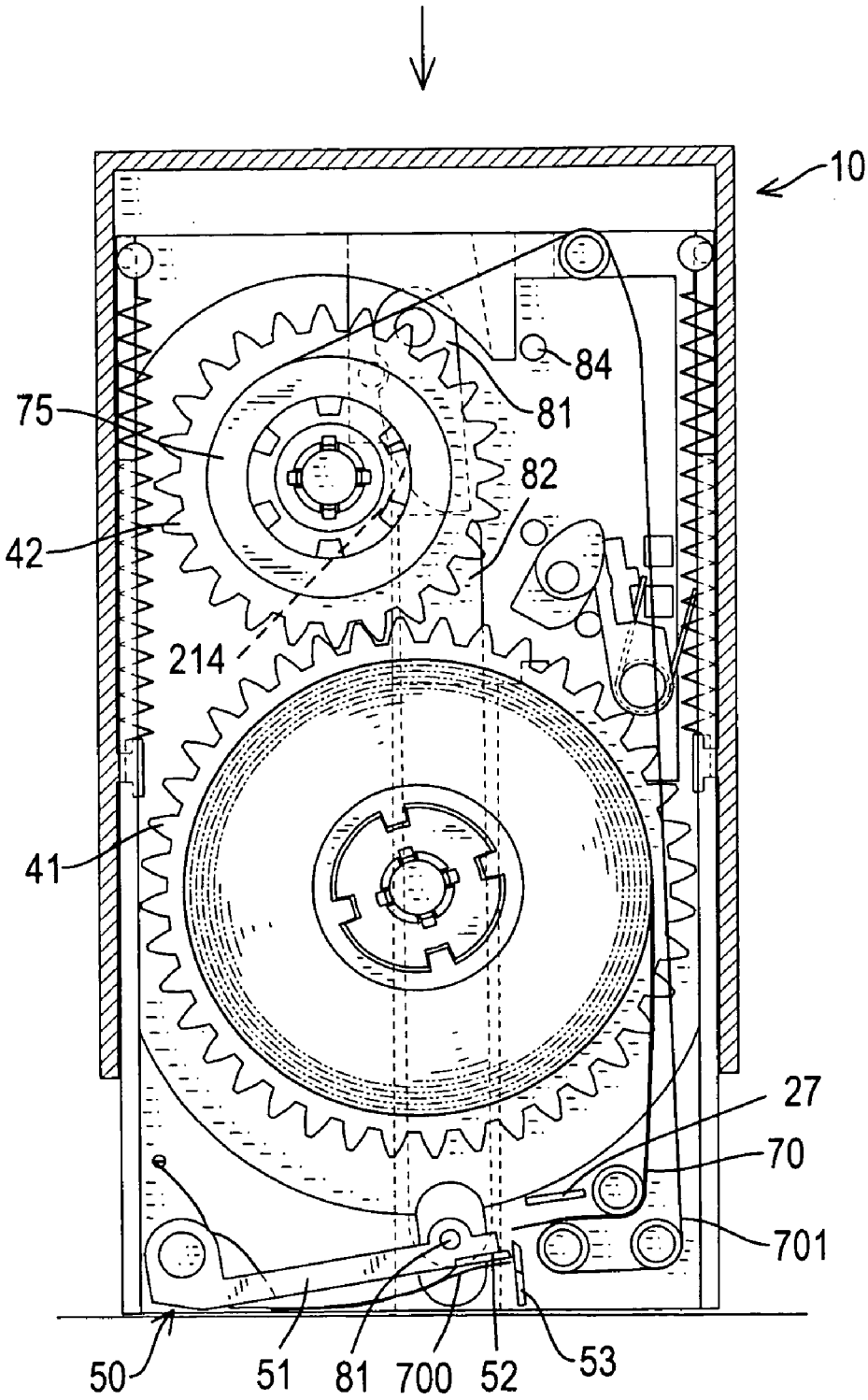
FIG. 4 is a cross sectional view of the magnetic adhesive tape holder when the upper housing is pressed further towards the lower housing.

With reference to FIG. 4, when the arcuate edge of the rotating cam (81) is blocked by the first step (214), the rotating cam (81) is slightly pivoted towards the second stop lug (84) and pushes the push bar (82) to move downwards. Therefore, the arm (51) along with the first blade (52) is pushed by the bolt (821) to pivot downwards. Then, the magnetic adhesive tape (70) is cut off by the two blades (52, 53), and the cut segment (700) of magnetic adhesive tape (51) is attracted on the arcuate elastic iron strip (54). A free end of the remainder magnetic adhesive tape (70) will be moved upwards at the moment of cutting the magnetic adhesive tape (51). However, the free end is stopped by the shield (27) to be located between the second blade (53) and the shield (27).

Figure 5:
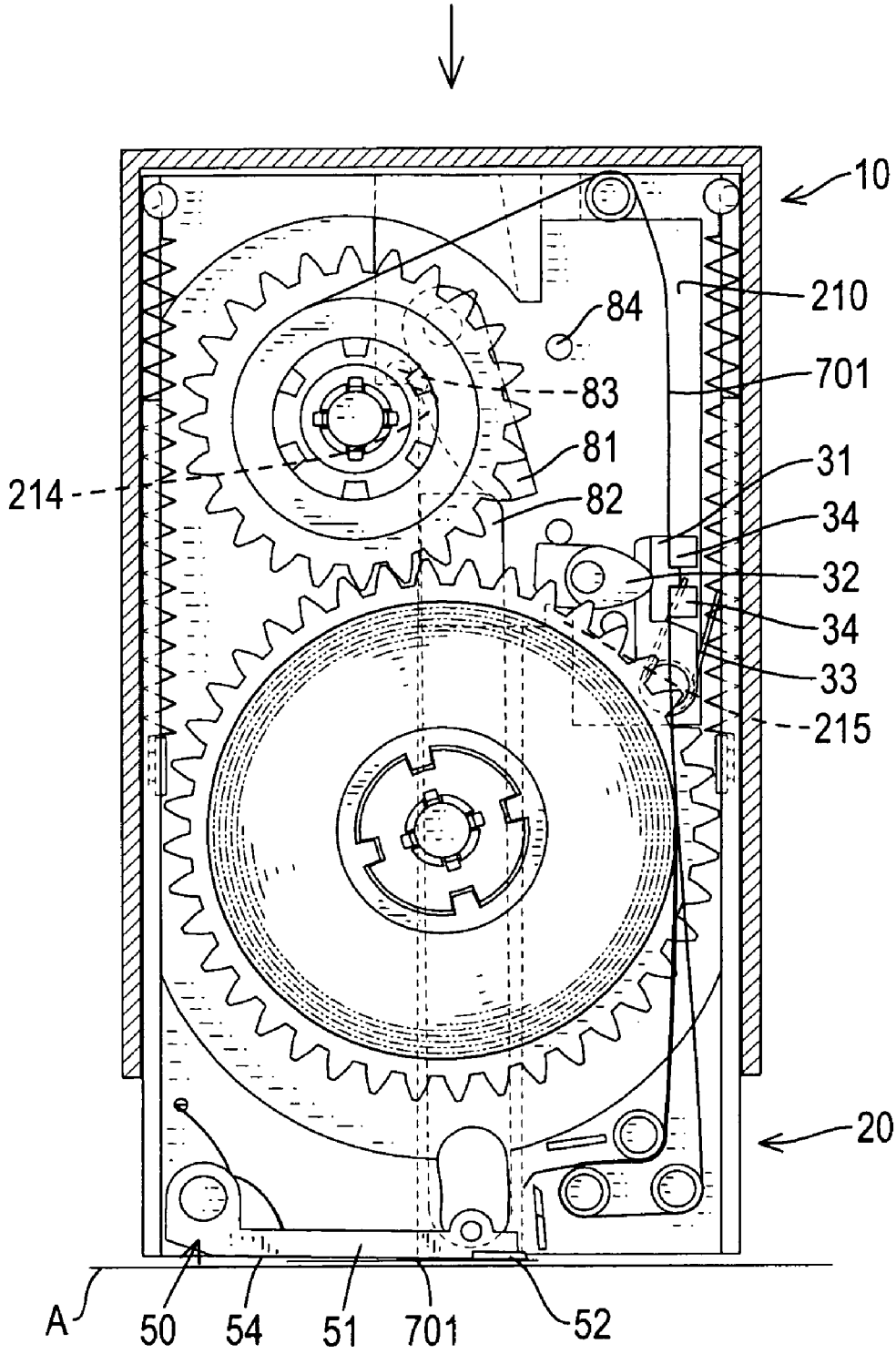
FIG. 5 is a cross sectional view showing a cut-off segment of the magnetic adhesive tape being stuck on an article.

With reference to FIG. 5, after the magnetic adhesive tape (70) has been cut, the upper housing (10) is further pushed to pivot the arm (51) downwards for sticking the segment of magnetic adhesive tape (700) on the article (A), i.e., the adhesive side of the segment of the magnetic adhesive tape (700) is stuck on the article (A).

In this case, the push bar (82) can not be pushed downwards further while the first stopping lug (83) is blocked by the first step (214) to disable the upper housing (10) to move downwards. The rotating cam (81) is pushed by the first step (214) to further pivot towards the second stopping lug (84) while the arcuate edge of the rotating cam (81) abuts the push bar (82). At the same time, the eccentric cam (32) is pushed by the second step (215) to pivot clockwise, so the movable clamper (31) is pushed by the eccentric cam (32) to pivot towards the stationary clamper (34). Therefore, the substrate tape (701) is clamped by the movable clamper (31) and stationary clampers (34). In this case, the eccentric cam (32) is positioned by the movable clamper (31) and the first stop pin (35) and will not automatically pivot backwards to the original status for ensuring the substrate tape (701) to be clamped by the movable clamper (31) and stationary clampers (34).

Figure 6:
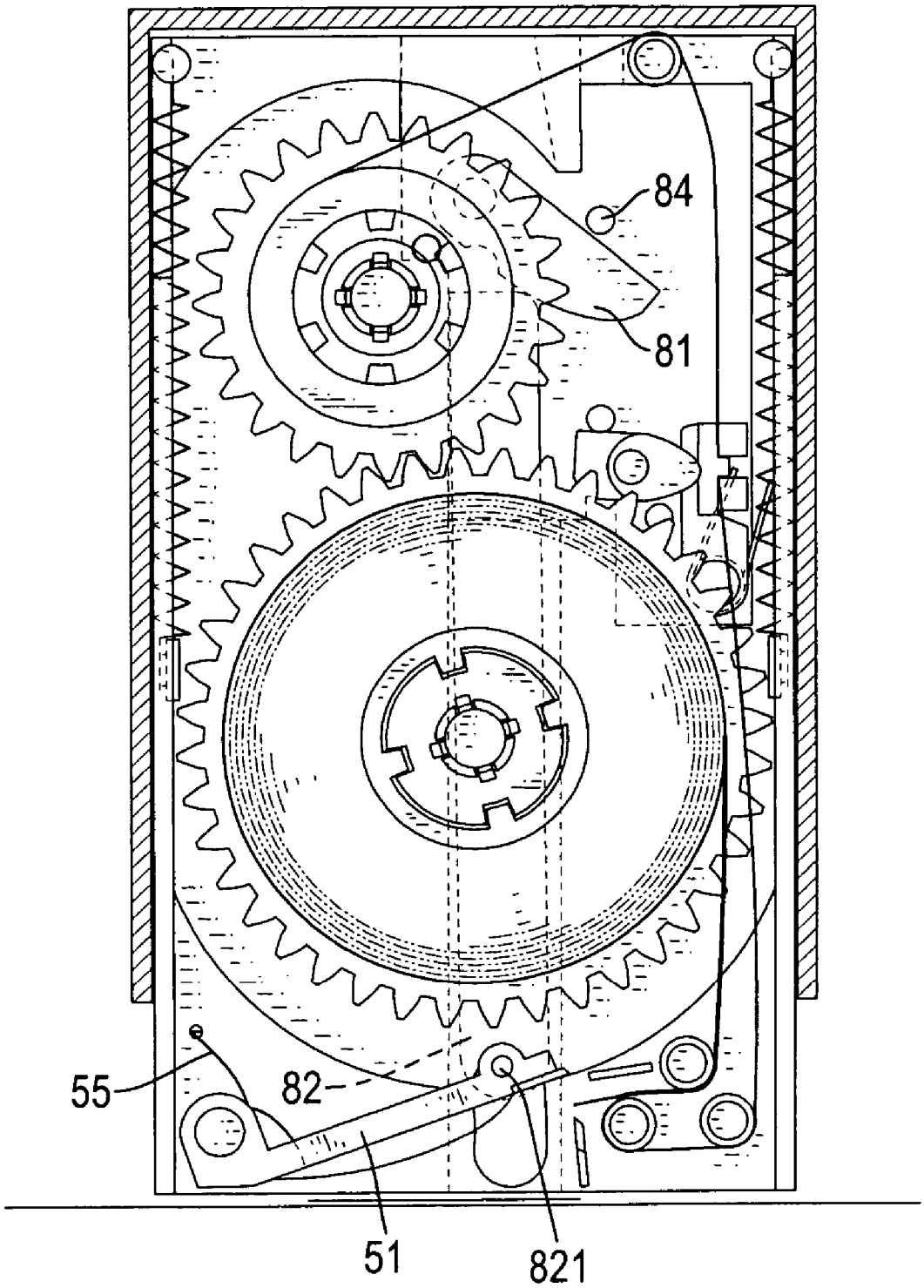
FIG. 6 is a cross sectional view showing an arm of a cutting member being pivoted backwards.

With reference to FIG. 6, the arm (51) is pivoted upwards due to the elastic force of the second resilient member (55), so the push bar (82) is moved upwards to push the rotating cam (81) to pivot counterclockwise until the straight edge abuts the second stop lug (84).

Figure 7:
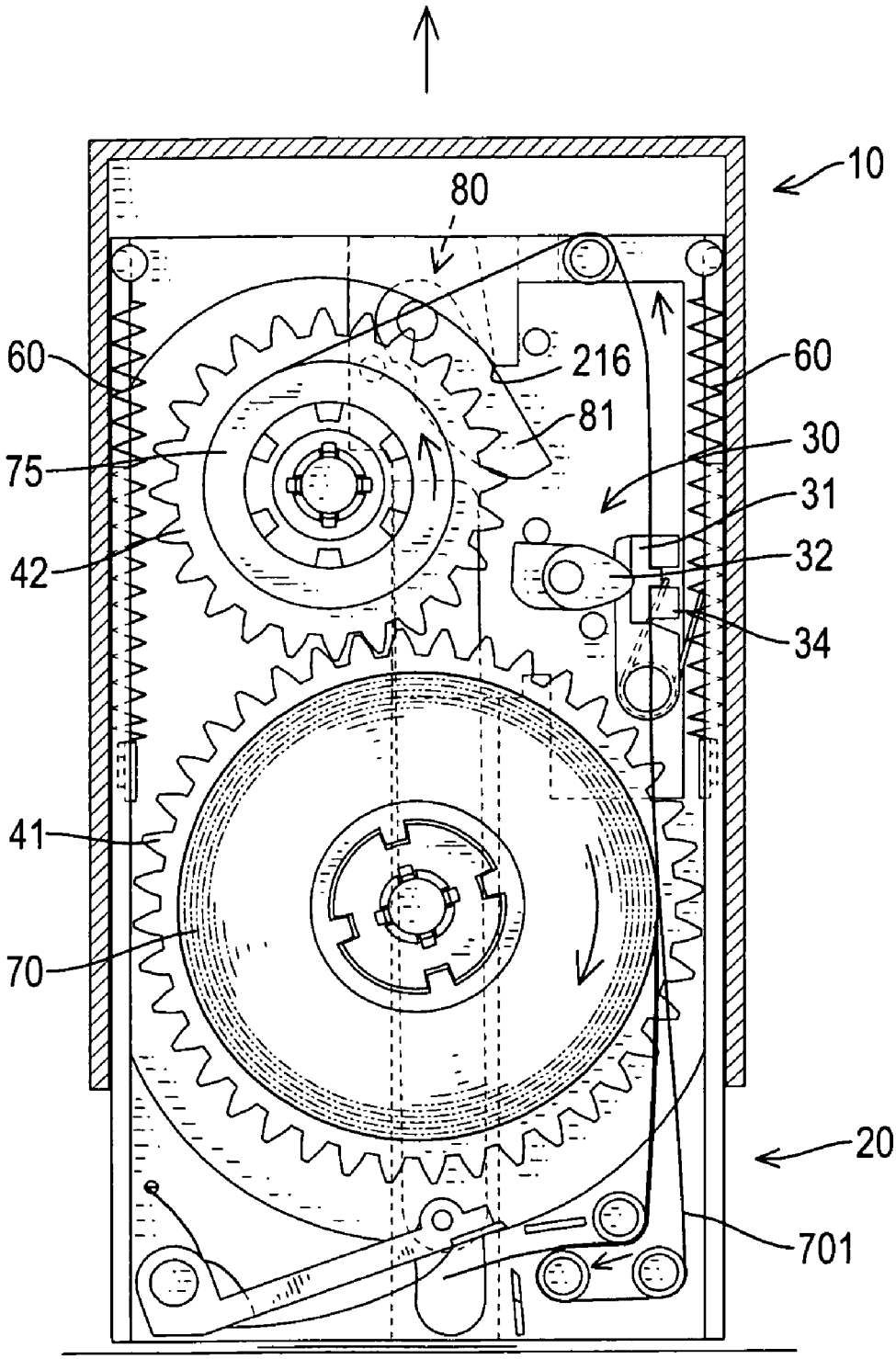
FIG. 7 is a cross sectional view showing the upper housing is pushed backwards while the magnetic adhesive tape is pulled out.

With reference to FIG. 7, when the upper housing (10) is released, the upper housing (10) along with the rotating cam (81) and clamping member (30) is moved upwards due to the elastic force of the first resilient members (60). Thus, the substrate tape (701) is pulled upwards along with the clamping member (30) while the magnetic adhesive tape (70) is also pulled out, so the first gear (41) and second gear (42) are rotated to reel the substrate tape (701) on the sleeve (75). During the movement of the upper housing (10), the rotating cam (81) is pivoted downwards when the rotating cam (81) abuts the first stopping portion (216).

Figure 8:
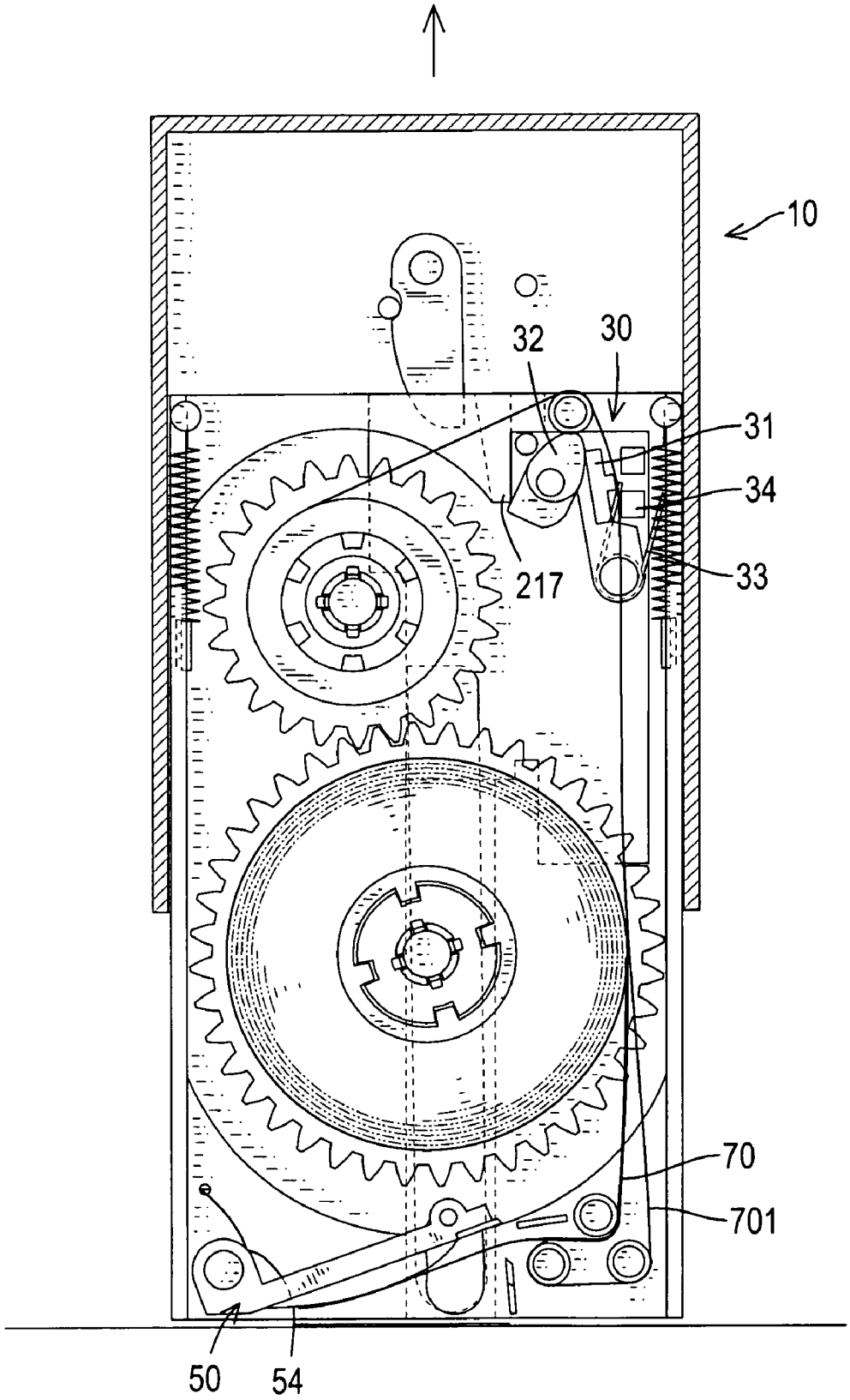
FIG. 8 is a cross sectional view showing that the upper housing is back to the original position and a clamping member is back to the open status.

With reference to FIG. 8, when the upper housing (10) is moved upwards further, the magnetic adhesive tape (70) extends towards the arm (51) and is attracted by the arcuate elastic iron strip (51). The eccentric cam (32) abuts the second stopping portion (217) to pivot counterclockwise, so the movable clamper (31) is pivoted backwards to release the substrate tape (701). Thus, the magnetic adhesive holder is returned to the original status as illustrated in FIG. 2.

Therefore, by pressing the upper housing (10), a segment of magnetic adhesive tape (70) with a certain length is cut off and stuck on the article. By releasing the upper housing (10), a segment of magnetic adhesive tape (70) with the same length is pulled out for the next cutting. Therefore, the roll of magnetic adhesive tape (70) can be automatically and easily cut off with a determined length for being stuck on the article It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A magnetic adhesive tape holder comprising:

an upper housing (10) having a first rear wall (11);

a lower housing (20) movably received in the upper housing (10) and having a second rear wall (21) adjacent the first rear wall (11), and an opening (210) defined through the second rear wall (21);

two first resilient members (60) provided between the upper housing (10) and lower housing (20) to give the lower housing (20) a tendency to move away from the upper housing (10);

a clamping member (30) formed on the first rear wall (11) and extending through the opening (210), the clamping member (30) being in an open status when the upper housing (10) is not pressed towards the lower housing (20) and located near a top of the opening (210), and in a closed status when the upper housing (10) is pressed towards the lower housing (20) and located near a bottom of the opening (210);

a first gear (41) rotatably mounted on the second rear wall (21) and adjacent a bottom of the lower housing (20);

a second gear (42) rotatably mounted on the first rear wall (11) and engaged with and above the first gear (41); and a cutting member (50) mounted on the second rear wall (21) and beneath the first gear (41).

2. The magnetic adhesive tape holder as claimed in claim 1, wherein the cutting member (50) includes an immovable blade (53).

3. The magnetic adhesive tape holder as claimed in claim 1, wherein the lower housing (20) has a guide slot (211) defined at a back surface of the second rear wall (21) and partially communicated with the opening (210);

a pushing member (80) is provided between the upper housing (10) and lower housing (20), the pushing member (80) having a rotating cam (81) pivotally mounted on the first rear wall (11) and above the guide slot (211), and a push bar (82) movably received in the guide slot (211); and the cutting member (50) includes an arm (51) with a pivot end on the second rear wall and a free end extending towards the guide slot (211), a movable blade (52) provided at the free end of the arm (51), and an immovable blade (53) secured on the second rear wall (21) and beneath the movable blade (52); the arm (51) has a tendency to pivot upwards and a cutting action is achieved by the movable blade (52) and the immovable blade (53) when the arm (51) is pushed by an external force to pivot downwards.

4. The magnetic adhesive tape holder as claimed in claim 3, wherein the cutting member (50) further has an elastic iron strip (54) formed on a bottom surface of the arm (51) for attracting a magnetic adhesive tape.

5. The magnetic adhesive tape holder as claimed in claim 4, wherein the elastic iron strip (54) is bent outwards to form an arcuate shape.

6. The magnetic adhesive tape holder as claimed in claim 3, wherein the lower housing (20) has a hole (212) defined at a bottom thereof, and the push bar (82) has a bolt (821) formed at a bottom end thereof and extending through the hole (212) and into the free end of the arm (51).

7. The magnetic adhesive tape holder as claimed in claim 1, wherein the clamping member has a movable damper (31) pivotally mounted on the first rear wall (11), at least one stationary damper (34) secured beside the movable damper (31), an eccentric cam (32) pivotally mounted opposite to the at least one stationary damper (34), a torsion spring (33) mounted on the movable damper (31) to give the movable damper (31) a tendency to abut the eccentric cam (32), and the movable cam (31) will be pushed by the eccentric cam (32) towards the stationary damper (34) for clamping the substrate tape.

8. The magnetic adhesive tape holder as claimed in claim 6, wherein the second rear wall (21) has a first step (214) formed in the opening (210) and located in the guide slot (211) and aligned with the rotating cam (81), and a first stopping portion (216) formed at a top of the opening (210) and facing the rotating cam (81).

9. The magnetic adhesive tape holder as claimed in claim 6, wherein a first stop lug (83) and a second stop lug (84) are respectively provided at two opposed sides of the rotating cam (81), and the rotating cam (81) has an arcuate edge facing the first stop lug (83) and a substantially straight edge facing the second stop lug (84).

10. The magnetic adhesive tape holder as claimed in claim 7, wherein the second rear wall (21) has a second step (215) formed in the opening (210) and aligned with the eccentric cam (32), and a second stopping portion (217) is formed at a top of the opening (210) and faces the eccentric cam (32).

11. The magnetic adhesive tape holder as claimed in claim 9, wherein the pushing member (80) further has a first stop lug (83) and a second stop lug (84) respectively formed at two sides of the rotating cam (81), wherein the rotating cam (81) has an arcuate edge facing the first stop lug (83), and a substantially straight edge facing the second stop lug (84).

12. The magnetic adhesive tape holder as claimed in claim 1, wherein the upper housing (10) has two opposed first sidewalls (12) perpendicular to the first rear wall (11); two first pins (14) are respectively formed at the first sidewalls (12); the lower housing (20) has two opposed second sidewalls (22) perpendicular to the second rear wall (21); two second pins (221) are respectively formed at the second sidewalls (22); and the two first resilient members (60) are respectively connected between the first pins (14) and second pins (221).

13. The magnetic adhesive tape holder as claimed in claim 1, wherein the lower housing (20) further has an upper roller (25) formed above the clamping member (30), and at least one lower roller (24) formed beside the cutting member (50).

14. The magnetic adhesive tape holder as claimed in claim 13, wherein the lower housing (20) has three lower rollers (24) formed beside the cutting member (50) and including a top one and two bottom ones arranged as a triangle.

15. The magnetic adhesive tape holder as claimed in claim 13, wherein the lower housing (20) further has a shield (27) provided above the immovable blade (53).

16. The magnetic adhesive tape holder as claimed in claim 3, wherein the lower housing (20) further has an upper roller (25) formed above the clamping member (30), and at least one lower roller (24) formed beside the free end of the arm (51).

17. The magnetic adhesive tape holder as claimed in claim 16, wherein the lower housing (20) has three lower rollers (24) formed beside the cutting member (50) and including a top one and two bottom ones arranged as a triangle.

18. The magnetic adhesive tape holder as claimed in claim 17, wherein the lower housing (20) further has a shield (27) provided above the bottom one of the lower rollers (24) adjacent the immovable blade (53).

* * * * *